US007581644B2

(12) United States Patent
Wright

(10) Patent No.: US 7,581,644 B2
(45) Date of Patent: Sep. 1, 2009

(54) CARTON WITH DISPLAY WINDOW

(75) Inventor: Jeffrey T. Wright, Concord, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 575 days.

(21) Appl. No.: 11/127,378

(22) Filed: May 12, 2005

(65) Prior Publication Data

US 2006/0254954 A1 Nov. 16, 2006

(51) Int. Cl.
*B65D 25/54* (2006.01)

(52) U.S. Cl. ..... 206/775; 206/784

(58) Field of Classification Search ..... 206/775, 206/784, 216, 102, 581, 734, 387.11; 229/120.18, 229/162.1, 120.12, 117.16
See application file for complete search history.

(56) References Cited

U.S. PATENT DOCUMENTS 2,643,811 A * 6/1953 Bolding ..... 229/120.12
3,389,850 A * 6/1968 Rockefeller ..... 229/102
3,679,093 A * 7/1972 Chang ..... 220/574
4,930,637 A 6/1990 DeRoseau
5,375,700 A * 12/1994 Joss et al. ..... 206/734
5,379,886 A 1/1995 Brauner et al.
5,566,878 A * 10/1996 Peiffer et al. ..... 229/117.16
5,607,058 A * 3/1997 Huesman et al. ..... 206/581
5,907,944 A 6/1999 Giacoman
6,173,833 B1 1/2001 Strehlow
6,206,750 B1 * 3/2001 Barad et al. ..... 446/268
6,298,990 B1 10/2001 Amrod et al.
6,470,653 B1 10/2002 Lutz et al.
6,474,539 B1 * 11/2002 Van Der Horst ..... 229/120.14
6,679,029 B2 1/2004 Clay
6,802,415 B2 * 10/2004 Loeffler ..... 206/216
6,823,988 B2 * 11/2004 Ryan et al. ..... 206/216
2002/0088730 A1 7/2002 Galomb
2004/0163986 A1 8/2004 Pinyot

* cited by examiner

*Primary Examiner*—Bryon P Gehman
*Assistant Examiner*—Ernesto A Grano
(74) *Attorney, Agent, or Firm*—Womble Carlyle Sandridge & Rice, PLLC

(57) ABSTRACT

A carton is formed from a blank having a longitudinal length and a transverse width. The blank has a front panel with a display window, a first side panel, a back panel, a second side panel, and a display panel. The display panel has a central portion and a marginal portion that circumscribes the central portion. The marginal portion is at least partially defined by at least two spaced-apart transverse fold lines and at least two longitudinal edges extending between the fold lines. At least a portion of the display panel is positionable to face the display window in the carton formed from the blank. At least one strut is cut from the central portion of the display panel. Each strut comprises a base panel foldably connected to the display panel and an adhesive flap foldably connected to the base panel.

22 Claims, 6 Drawing Sheets

CARTON WITH DISPLAY WINDOW

BACKGROUND

Premium articles have been used to promote the sale of products enclosed within cartons. For example, toys and other novelty items have been mounted in cartons containing food products in order to enhance the salability of the products. U.S. Pat. No. 5,379,886 to Brauner et al. discloses one such product. Brauner's package, however, requires the use of a separate premium tray to house a promotional product, which increases the cost and difficulty of manufacture of the package.

SUMMARY

According to a first embodiment, a carton blank comprises a front panel having a display window, a first side panel, a back panel, a second side panel, a display panel, at least one top flap extending across a first marginal potion of the blank, and at least one bottom flap extending across a second marginal portion of the blank. When the carton is assembled from the blank, a portion of the display panel faces the display window.

According to the first embodiment, an article can be mounted within the carton between the display panel and the display window, where it is visible from the exterior of the carton. Additional mounting trays or inserts are not required, which reduces the cost of manufacture. In alternative embodiments, graphical and/or textual information can be printed on the display panel such that it is visible through the display window.

The article may kept separate from the contents of the carton, which prevents contamination of the carton contents and reduces the likelihood of damage to the article. The size of the display window can be selected so that the article may not be removed through the display window, which reduces the likelihood of pilferage of the article.

Other aspects, features, and details of the present invention can be more completely understood by reference to the following detailed description of a preferred embodiment, taken in conjunction with the drawings and from the appended claims.

BRIEF DESCRIPTION OF THE DRAWING FIGURES

DETAILED DESCRIPTION

The present embodiments are addressed to cartons having display features which allow a premium, product information, and/or other items to be viewed from an exterior of the cartons.

Figure 1:
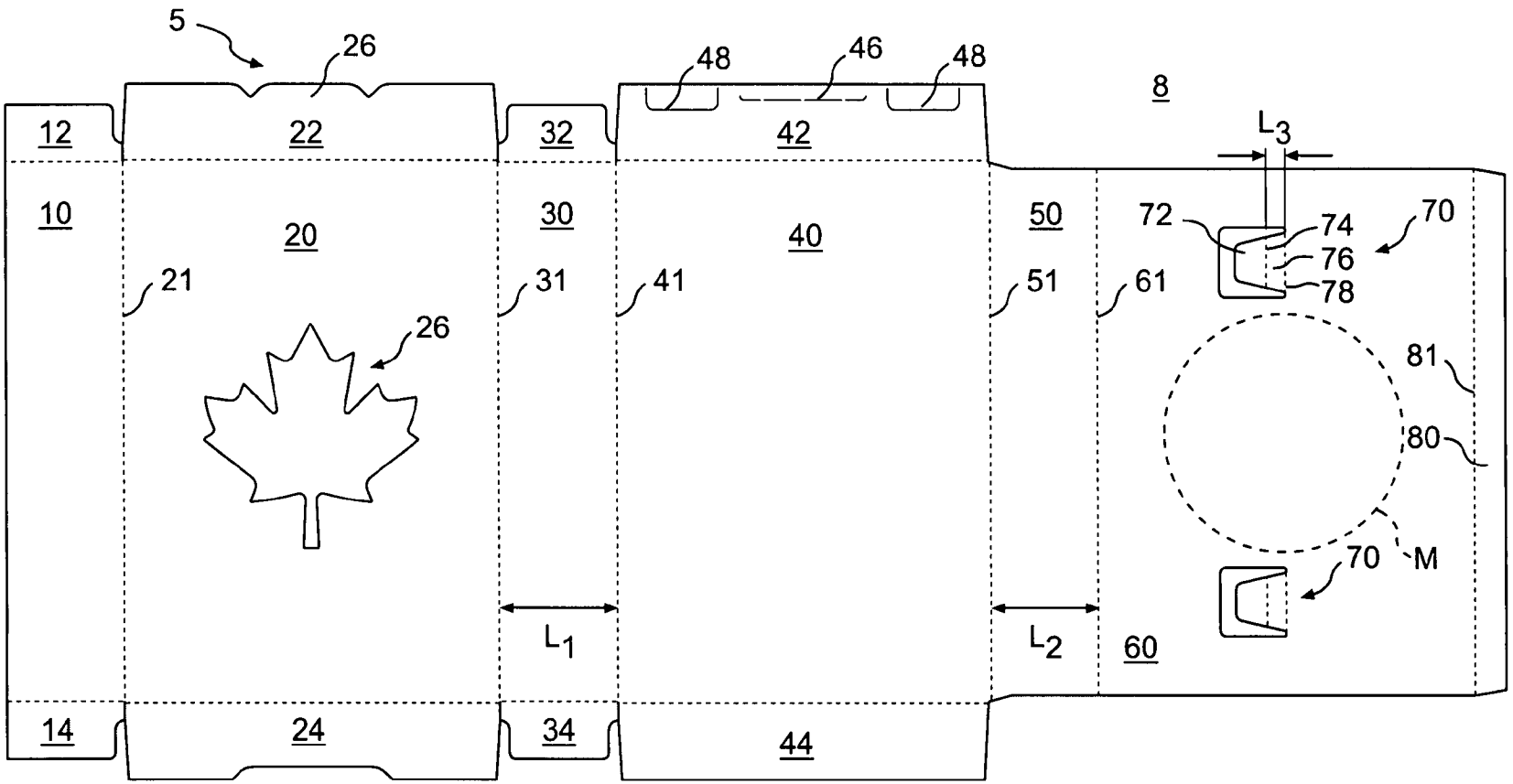
FIG. 1 is a plan view of a blank used to form a carton according to a first embodiment.

FIG. 1 is a plan view of a first, interior side 5 of a blank 8 used to form a carton 100 (illustrated in FIG. 6) according to a first embodiment. The first side 5 will be disposed in the interior of the assembled carton 100.

The blank 8 comprises a first side panel 10 foldably connected to a front panel 20 at a first transverse fold line 21, a second side panel 30 foldably connected to the front panel 20 at a second transverse fold line 31, a back panel 40 foldably connected to the first side panel 30 at a third transverse fold line 41, a third side panel 50 foldably connected to the back panel 40 at a fourth transverse fold line 51, a display panel 60 foldably connected to the third side panel 50 at a fifth transverse fold line 61, and an adhesive flap 80 foldably connected to the display panel 60 at a sixth transverse fold line 81.

The first side panel 10 is foldably connected to a side top flap 12 and a side bottom flap 14. The front panel 20 is foldably connected to a front top flap 22 and a front bottom flap 24. The second side panel 30 is foldably connected to a side top flap 32 and a side bottom flap 34. The back panel 40 is foldably connected to a back top flap 42 and a back bottom flap 44. The flaps 12, 22, 32, 42 extend along a top marginal area of the blank 8, and the flaps 14, 24, 34, 44 extend along a bottom marginal area of the blank 8. When the carton 100 is assembled, the flaps 12, 22, 32, 42 close a top opening of the carton 100, and the flaps 14, 24, 34, 44 close a bottom opening of the carton 100.

The front top flap 22 can include a closure tab 26 that is sized to be received in a closure slit 46 formed in the back top flap 42. The closure tab 26 and closure slit 46 provide for recloseable sealing of the carton 100 after the top of the carton 100 has been opened. Glue release cuts 48 can also be included in the back top flap 42 to aid in opening of the carton 100.

Figure 2:
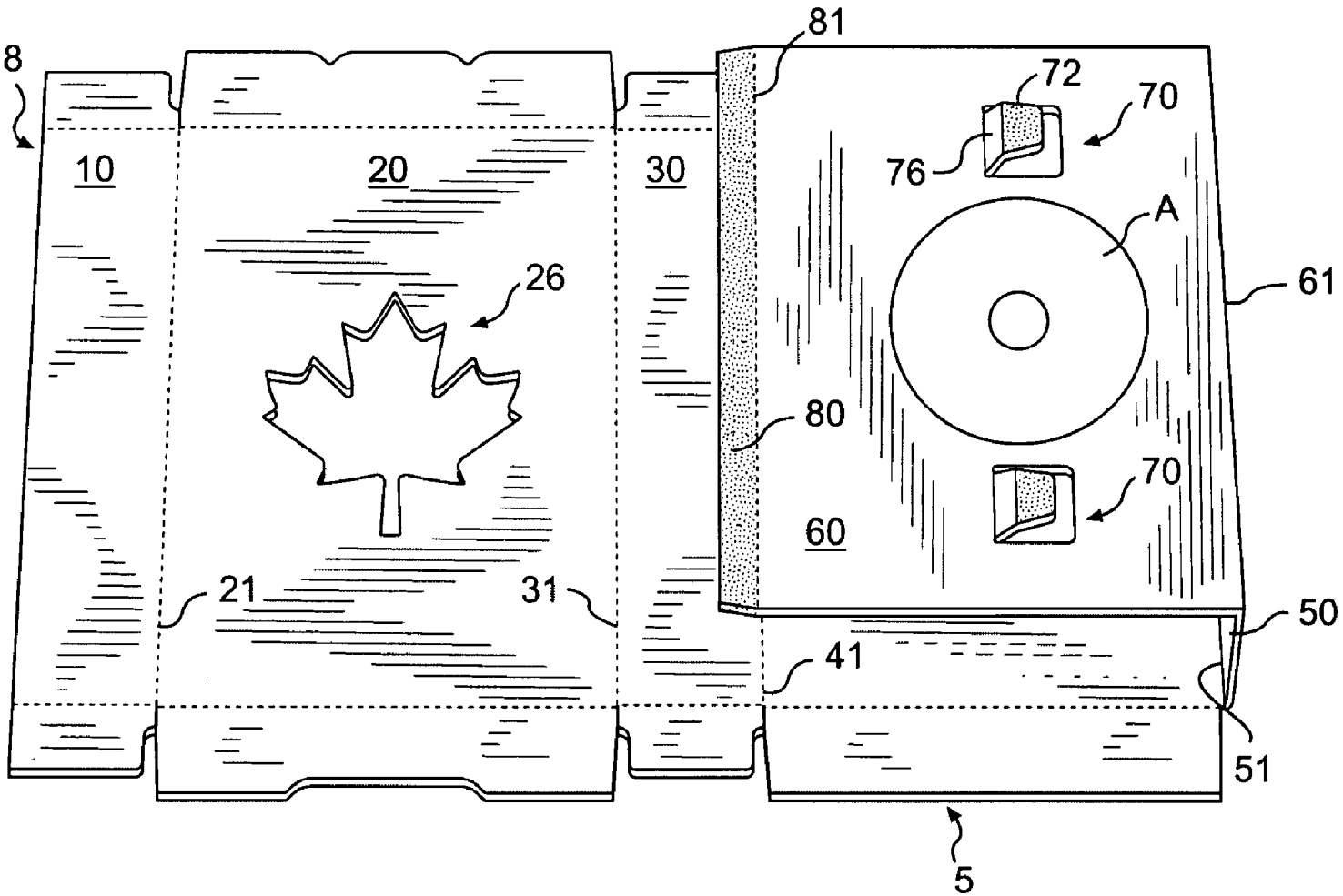
FIG. 2 is a perspective view of the blank partially erected.

A display window or aperture 26 is formed in the front panel 20. The display window 26 is arranged in the front panel 20 so that when the carton 100 is erected, a premium article A (shown in FIG. 2) mounted on a display side of the display panel 60 is visible through the window 26. The premium article A, as shown in FIG. 2, will be mounted on the opposite, exterior, side of the blank 8, at a location generally indicated by the area M in FIG. 1. The display panel 60 includes struts 70 cut from the display panel 60. Each strut 70 includes a base panel 76 connected to the display panel 60 at a fold line 78, and an adhesive flap or tab 72 connected to the base panel 76 at a fold line 74. The struts 70 provide an offset spacing of the display panel 60 from the front panel 20. In the assembled carton 100, the offset spacing between the display panel 60 and the front panel 20 is generally defined by the length $L_3$ of the base panels 76. The length $L_1$ of the first side panel 30 may be, for example, approximately equal to the length $L_2$ of the second side panel 30 plus the length $L_3$ of the base panels 76.

FIG. 2 is a perspective view of the blank 8 partially erected. In practice, the blank 8 may remain generally flat during this stage of erection, with 180 degree folding occurring at fold lines 61 and 41. For the purpose of illustrating the final arrangement of the display panel 60 and the struts 70, however, FIG. 2 shows the blank 8 folded about fold lines 51 and 61, and the struts 70 in an erect position. Initially, glue or other adhesive is applied to the adhesive flap 80 as indicated by the stippling, as well as on the tabs 72. Adhesive is also applied to the display panel 60 at a location where the article A is to be applied, and to the exterior side of the third side panel 50. The blank 8 is then folded 180 degrees about the fold line 61, and the article A is adhered to the display panel 60. After adhering the article A to the panel 60, the blank 8 is then folded 180 degrees about the fold line 41. Folding about the fold line 41 brings the second side panel 30 into contact with the adhesive on the adhesive flap 80, and the adhesive on the struts 70 into contact with the front panel 20.

Figure 3:
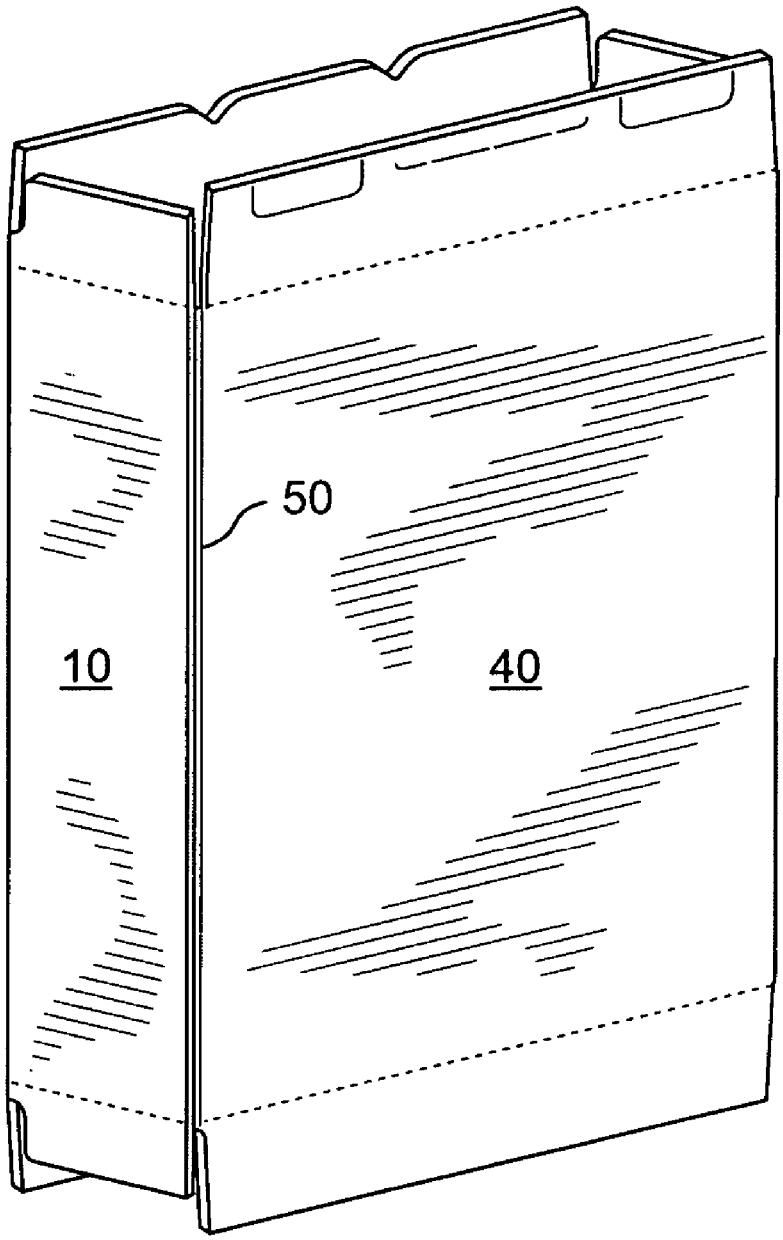
FIG. 3 is a perspective view of the carton partially erected.
Figure 4:
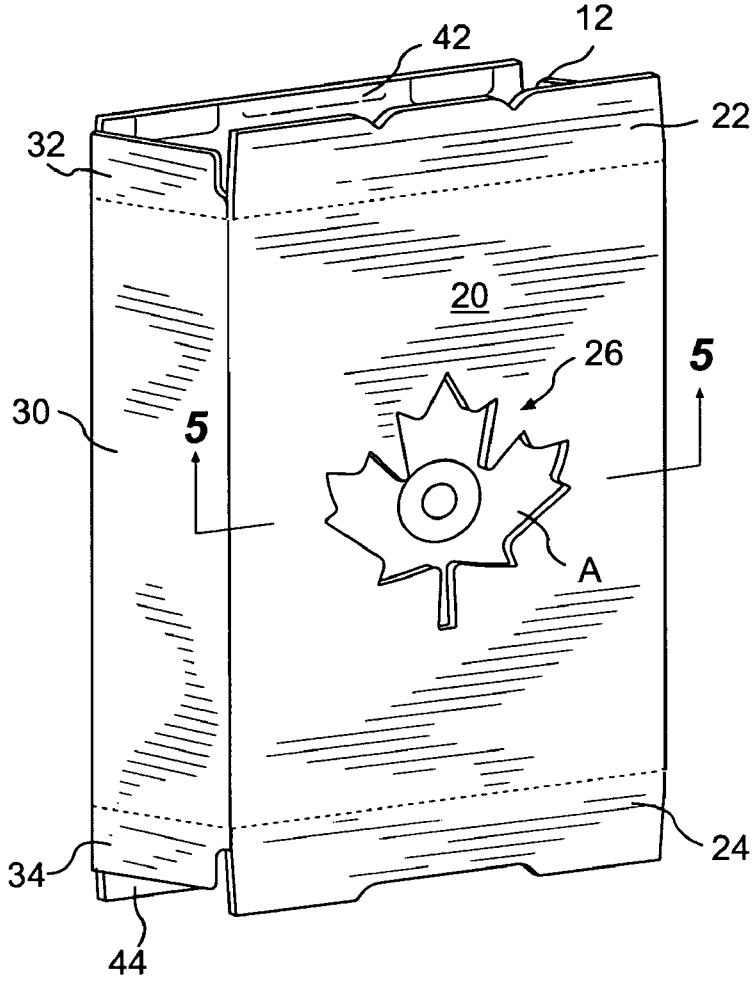
FIG. 4 is a perspective view of the carton partially erected.
Figure 5:
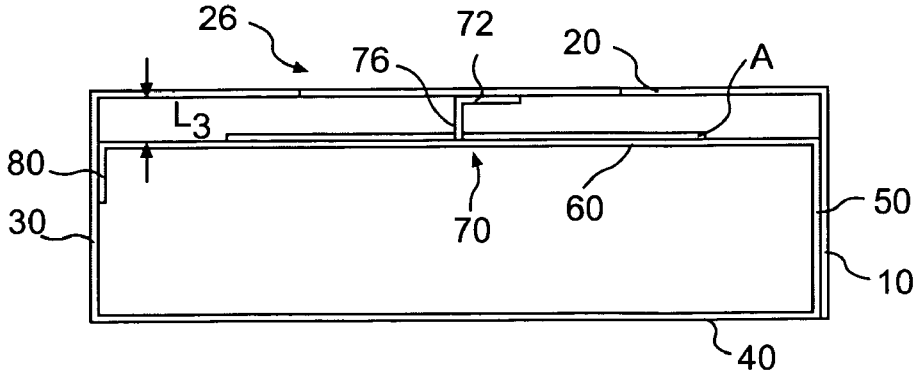
FIG. 5 is a section view taken on line 5-5 in FIG. 4.

Referring to FIG. 3, the first side panel 10 is adhered to the third side panel 50, and the resulting article is "opened" so that it has a tubular configuration. FIG. 4 is a front perspective view of the partially assembled carton, and FIG. 5 is a section view taken on line 5-5 in FIG. 4. As shown in FIG. 5, the struts 70 offset the display panel 60 from the front panel 20 by a distance that may be equal to or approximately equal to the length $L_3$ of the base panels 76. The article A is disposed on the display panel 60 so that it is visible through the display window 26 in the front panel 20.

Figure 6:
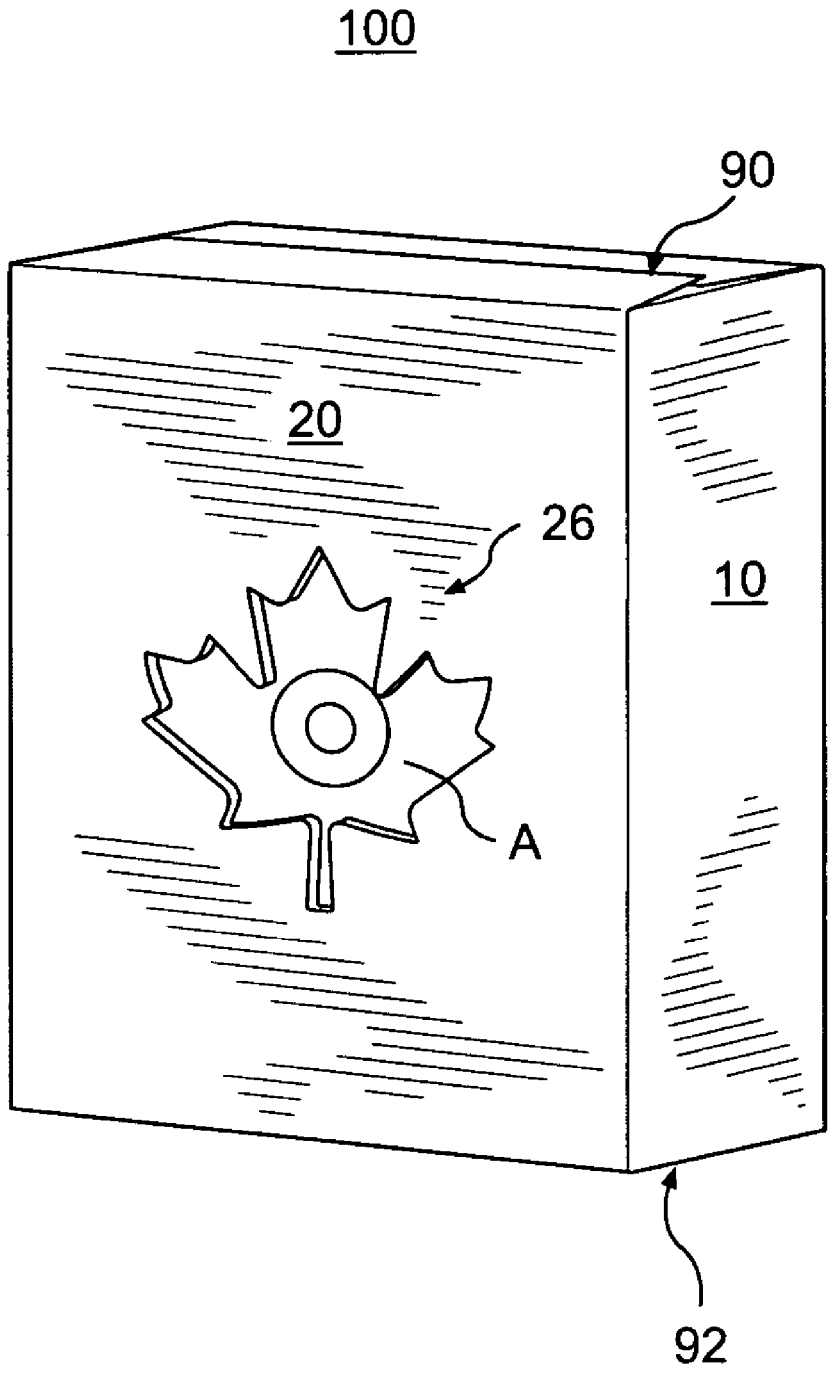
FIG. 6 is a perspective view of the assembled carton.

Referring also to FIG. 6, the flaps 12, 14, 22, 24, 32, 34, 42, 44 may be adhered by glue or other adhesives in a conventional manner, resulting in the carton 100 illustrated in FIG. 6. A bag (not shown) or other vessel filled with product may be inserted in the carton in a conventional manner before closing the flaps 12, 14, 22, 24, 32, 34, 42, 44. As shown in FIG. 6, the finished carton 100 has a top panel 90 formed from the flaps 12, 22, 32, 42, and a bottom panel 92 formed from the flaps 14, 24, 34, 44. The display window 26 allows a consumer to view the premium article A, and if desired, to touch or otherwise evaluate the article A.

The premium article A can be, for example, any item used to enhance the salability or desirability of a product contained within the assembled carton 100. For example, the premium article A is illustrated in FIG. 2 as a compact disc. As an alternative to or in combination with the premium article A, the display panel 60 could also include, for example, an image or other graphical, textual, or product information. If there is no premium article A applied to the display panel 60, a printing step may be used to apply an image to the display panel 60, and an article adhesion step may be omitted. If desired, the display window 26 may be covered by a clear layer of film or other material.

Figure 7:
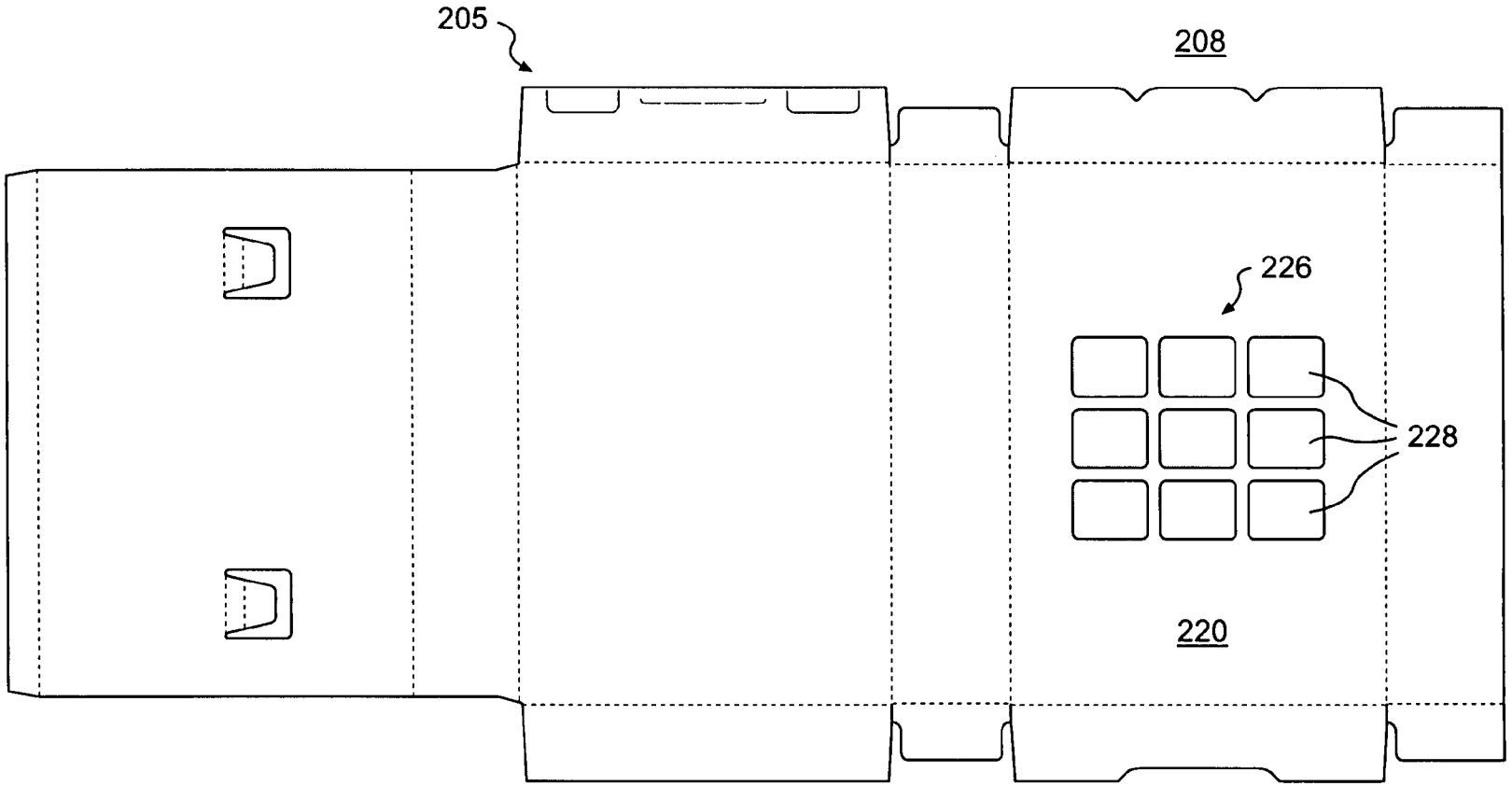
FIG. 7 is a plan view of a blank used to form a carton according to a second embodiment.

FIG. 7 is a plan view of a blank 208 used to form a carton according to a second embodiment. The blank 208 is generally identical to the blank illustrated in FIG. 1, except that the display window 226 in the front panel 220 is formed from a plurality apertures 228. The apertures 228 are generally rectangular and are arranged in a grid of columns and rows. The grid of apertures 228 can be used to create special optical effects for a consumer viewing an article disposed behind the window 226.

According to the above embodiments, product salability can be enhanced by an article mounted within the carton between the display panel and the display window, where it is visible from the exterior of the carton. The article is kept separate from the contents of the carton, which prevents contamination of the carton contents and reduces the likelihood of damage to the article. In some embodiments, the size of the display window can be selected so that the article may not be removed through the display window, which reduces the likelihood of pilferage of the article. Graphical and/or textual information can also be printed on the display panel such that it is visible and/or accessible through the display window.

In the exemplary embodiments discussed above, the blanks may be formed from clay coated newsprint (CCN). In general, the blanks may be constructed of paperboard, having a caliper of at least about 14, so that they are heavier and more rigid than ordinary paper. The blanks, and thus the cartons, can also be constructed of other materials, such as cardboard, or any other material having properties suitable for enabling the cartons to function at least generally as described above. The first and second sides of the blanks can be coated with, for example, a clay coating. The clay coating may then be printed over with product, advertising, and other information or images. The blanks may then be coated with a varnish to protect any information printed on the blank. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton blank for forming a carton, the blank having a longitudinal length and a transverse width, the blank comprising:

a front panel having a display window;

a first side panel;

a back panel;

a second side panel;

a display panel, the display panel having a central portion and a marginal portion that circumscribes the central portion, the marginal portion being at least partially defined by at least two spaced-apart transverse fold lines and at least two longitudinal edges extending between the fold lines;

at least one top flap extending across a first marginal portion of the blank;

at least one bottom flap extending across a second marginal portion of the blank, at least a portion of the display panel is positionable to face the display window when the blank is formed into the carton; and at least one strut cut from the central portion of the display panel, each strut comprising a base panel foldably connected to the display panel and an adhesive flap foldably connected to the base panel.

2. The blank of claim 1, wherein a length of the front panel is approximately equal to a length of the back panel.

3. The blank of claim 2, further comprising a third side panel foldably connected to the back panel and the display panel and having a length that is less than a length of the first side panel and a length of the second side panel.

4. The blank of claim 3, wherein the front panel, the first side panel, the back panel, and the second side panel are substantially rectangular.

5. A carton assembled from the blank of claim 3, wherein the front panel, the back panel, and the display panel are substantially parallel to one another.

6. The carton of claim 5, wherein the at least one strut connects the front panel to the display panel.

7. A method of erecting a carton, comprising:

providing a blank according to claim 1;

folding the blank so that the front panel, the display panel, and the back panel are substantially parallel to one another;

securing the at least one top flap to form a top panel; and securing the at least one bottom flap to form a bottom panel, wherein a portion of the display panel faces the display window.

8. The method of claim 7, further comprising applying a premium article to the display panel before securing the at least one top flap to form a top panel.

9. A carton, comprising:

a front panel having a display window;

a back panel;

a first side panel adjacent to the front panel and the back panel;

a second side panel adjacent to the front panel and the back panel;

a display panel disposed between and spaced from the front panel and the back panel, the display panel having a width extending from the first side panel to the second side panel and a length generally transverse to the width, a central portion, and a marginal portion that circumscribes the central portion, the marginal portion being at least partially defined by at least two spaced-apart transverse fold lines extending along the length of the display panel and at least two edges extending between the transverse fold lines;

a top panel;

a bottom panel, wherein at least a portion of the display panel faces the display window; and at least one strut cut from the central portion of the display panel, each strut comprising a base panel foldably connected to the display panel and an adhesive flap foldably connected to the base panel and adhered to the front panel.

10. The carton of claim 9, further comprising a third side panel foldably connected to the display panel and overlapping the first side panel.

11. The carton of claim 9, further comprising an article disposed between the display panel and the display window, wherein the article is visible from an exterior of the carton through the display window.

12. The carton of claim 9, wherein the display panel is visible from an exterior of the carton through the display window.

13. The carton of claim 9, further comprising a vessel disposed between the display panel and the back panel, wherein the vessel contains a food product.

14. The carton of claim 9, wherein the carton is substantially parallelepipedal.

15. The carton of claim 9 wherein each strut of the at least one strut forms an aperture in the display panel.

16. The carton of claim 9 wherein each strut of the at least one strut has three edges, each of the three edges being adjacent respective edges of the central portion of the display panel.

17. The carton of claim 9 wherein each strut of the at least one strut is foldably connected to the central portion at a fold line, the fold line being spaced inward from the marginal portion of the display panel.

18. A carton, comprising:

a front panel having a display window;

a back panel;

a first side panel adjacent to the front panel and the back panel;

a second side panel adjacent to the front panel and the back panel;

a display panel disposed between and spaced from the front panel and the back panel, wherein at least a portion of the display panel faces the display window, the display panel having a width extending from the first side panel to the second side panel and a length generally transverse to the width, a central portions and a marginal portion that circumscribes the central portion, the marginal portion being at least partially defined by at least two spaced-apart transverse fold lines extending along the length of the display panel and at least two edges extending between the transverse fold lines;

a top panel;

a bottom panel;

at least one member connecting the display panel to the front panel, the member at least partially providing the spacing between the display panel and the front panel, wherein the at least one member is cut from the central portion of the display panel and comprises a base panel foldably connected to the display panel, and an adhesive flap foldably connected to the base panel and adhered to the front panel; and a vessel containing a food product disposed between the back panel and the display panel.

19. The carton of claim 18, further comprising a third side panel foldably connected to the display panel and overlapping the first side panel.

20. The carton of claim 18, further comprising an article disposed between the display panel and the display window, wherein the article is visible from an exterior of the carton through the display window.

21. The carton of claim 18, wherein the display panel is visible from an exterior of the carton through the display window.

22. The carton of claim 18, wherein the carton is substantially parallelepipedal.

* * * * *